US009526307B1

(12) United States Patent
Hsieh

(10) Patent No.: US 9,526,307 B1
(45) Date of Patent: Dec. 27, 2016

(54) THREADED DRIVING STRUCTURE FOR AUTOMATIC UMBRELLA

(71) Applicant: Ai-Hui Huang, Changhua Hsien (TW)

(72) Inventor: David Hsieh, Changhua (TW)

(73) Assignee: Ai-Hui Huang, Changhua Hsien (TW)

( * ) Notice: Subject to any disclaimer, the term of this patent is extended or adjusted under 35 U.S.C. 154(b) by 0 days.

(21) Appl. No.: 14/734,152

(22) Filed: Jun. 9, 2015

(51) Int. Cl.
*A45B 25/16* (2006.01)
*A45B 25/00* (2006.01)
*A45B 25/14* (2006.01)

(52) U.S. Cl.
CPC ..... *A45B 25/006* (2013.01); *A45B 25/143* (2013.01); *A45B 25/16* (2013.01)

(58) Field of Classification Search
CPC ..... A45B 25/143; A45B 25/14; A45B 25/16; A45B 25/006; A45B 19/04; A45B 9/08; A45B 9/02; A45B 2017/005
USPC ..... 135/22, 24, 20.3, 25.33; 116/173
See application file for complete search history.

(56) References Cited

U.S. PATENT DOCUMENTS 4,424,824 A * 1/1984 Becher ..... A45B 19/04 135/20.3
6,341,613 B1 * 1/2002 Wu ..... A45B 25/143 135/22
6,543,464 B1 * 4/2003 Grady, II ..... A45B 25/14 135/20.3
7,562,666 B2 * 7/2009 Chan ..... A45B 25/143 135/16
7,909,049 B2 * 3/2011 Yang ..... A45B 19/04 135/20.3
7,997,290 B2 * 8/2011 Stoelinga ..... A45B 25/14 135/20.3
8,365,747 B1 * 2/2013 Su ..... A45B 25/16 135/22
8,757,183 B2 * 6/2014 Volin ..... A45B 25/143 135/20.3
8,757,184 B1 * 6/2014 Chen ..... A45B 19/04 135/20.3
8,857,453 B2 * 10/2014 Souma ..... A45B 25/143 135/20.3
9,259,064 B1 * 2/2016 Chen ..... A45B 25/143
9,265,314 B2 * 2/2016 Chen ..... A45B 25/143
9,282,793 B2 * 3/2016 Chen ..... A45B 25/143

* cited by examiner

*Primary Examiner* — Winnie Yip

(57) ABSTRACT

A threaded driving structure for an automatic umbrella contains: a first stick section and a second stick section fitted on and sliding relative to the first stick section. The first stick section includes a first fixing sleeve disposed on a top end thereof, and first fixing sleeve has a first orifice defined thereon. The second stick section includes a second fixing sleeve mounted on a top end thereof. The first stick section also includes a first support member with inner threads, and the second stick section includes a screw rod with outer threads, wherein an upper end of the screw rod is connected with the second fixing sleeve, and a lower end of the screw rod is screwed with the inner threads of the first support member via the first orifice, a lower end of the first support member is joined with a power apparatus.

2 Claims, 4 Drawing Sheets

THREADED DRIVING STRUCTURE FOR AUTOMATIC UMBRELLA

FIELD OF THE INVENTION

The present invention relates to an automatic umbrella, and more particularly to a threaded driving structure for an automatic umbrella.

BACKGROUND OF THE INVENTION

A conventional umbrella is manually operated and contains: a handle, a plurality of support ribs, and an umbrella fabric. However, such an umbrella cannot be operated automatically.

To overcome above-mentioned problem, an automatic umbrella has been developed. The automatic umbrella contains a button for driving the plurality of support ribs to stretch and retract, thus opening and closing the automatic umbrella easily.

This automatic umbrella also contains a stick section in which a first spring is fixed to stretch or retract the automatic umbrella, and a plurality of second springs are mounted on the plurality of support ribs to retract the automatic umbrella.

After the button is pressed to release the first spring, the first spring pushes the stick section to move upwardly, thus stretching the automatic umbrella quickly. Nevertheless, the first spring is released suddenly to produce excessive elasticity by which the stick section and a runner of the automatic umbrella are struck, thereby causing damage to the automatic umbrella and using inconvenience to a user.

The present invention has arisen to mitigate and/or obviate the afore-described disadvantages.

SUMMARY OF THE INVENTION

The primary objective of the present invention is to provide a threaded driving structure for an automatic umbrella which prolongs a service life of the automatic umbrella and operates the automatic umbrella easily.

To obtain the above objective, a threaded driving structure for an automatic umbrella provided by a first embodiment of the present invention contains: a first stick section and a second stick section fitted on an outer wall of the first stick section and sliding relative to the first stick section. The first stick section includes a first fixing sleeve disposed on a top end thereof, and the first fixing sleeve has a first orifice defined thereon, the second stick section includes a second fixing sleeve mounted on a top end thereof. The first stick section includes a first support member mounted therein, and the first support member has inner threads arranged therein. The second stick section includes a screw rod fixed therein, and the screw rod has outer threads arranged thereon, an upper end of the screw rod is connected with the second fixing sleeve, and a lower end of the screw rod is screwed with the inner threads of the first support member via the first orifice, a lower end of the first support member is joined with a power apparatus, such that the power apparatus drives the first support member to rotate, and then the screw rod moves upwardly and downwardly along the first support member.

The threaded driving structure further contains a third stick section fitted on an outer wall of the second stick section and sliding relative to the second stick section. The third stick section includes a third fixing sleeve disposed on a top end thereof, and the second fixing sleeve has a second orifice defined thereon. The third stick section also includes a second support member mounted therein, wherein an upper end of the second support member is in connection with the third fixing sleeve, and a lower end of the second support member is inserted into the second orifice. The second stick section further includes a first pull rope, an upper segment of which is coupled with the lower end of the second support member through a support portion on the second fixing sleeve. The screw rod also has an accommodation space formed therein to accommodate the second support member and the first pull rope.

In addition, a threaded driving structure for an automatic umbrella provided by a second embodiment of the present invention contains: a first stick section and a second stick section fitted on an outer wall of the first stick section and sliding relative to the first stick section. The first stick section includes a first fixing sleeve disposed on a top end thereof, and the first fixing sleeve has a first orifice defined thereon, the second stick section includes a second fixing sleeve mounted on a top end thereof. The first stick section includes a first support member mounted therein, and the first support member has outer threads arranged therein, the second stick section includes a screw rod fixed therein, and the screw rod has inner threads arranged thereon, an upper end of the screw rod is connected with the second fixing sleeve, and a lower end of the screw rod is screwed with the outer threads of the first support member via the first orifice, a lower end of the first support member is joined with a power apparatus, such that the power apparatus drives the first support member to rotate, and the screw rod moves upwardly and downwardly along the first support member.

The threaded driving structure further contains a third stick section fitted on an outer wall of the second stick section and sliding relative to the second stick section. The third stick section includes a third fixing sleeve disposed on a top end thereof, and the second fixing sleeve has a second orifice defined thereon. The third stick section also includes a second support member mounted therein, wherein an upper end of the second support member is in connection with the third fixing sleeve, and a lower end of the second support member is inserted into the second orifice. The second stick section further includes a first pull rope, an upper segment of which is coupled with the lower end of the second support member through a support portion on the second fixing sleeve. The first support member also has an accommodation space formed therein to accommodate the second support member and the first pull rope.

DETAILED DESCRIPTION OF THE PREFERRED EMBODIMENTS

A threaded driving structure is employed to an automatic umbrella with at least two stick sections.

Figure 1:
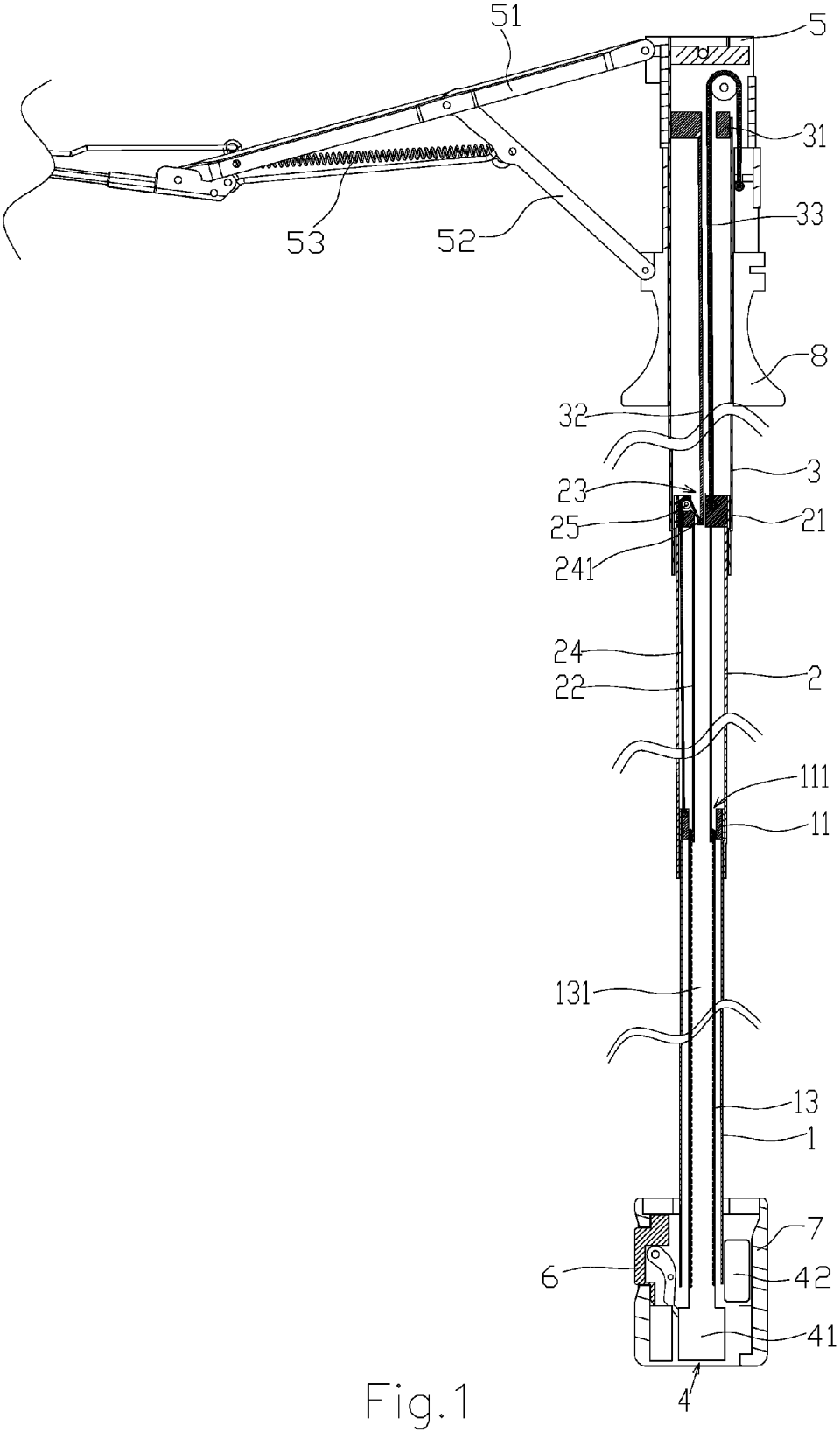
FIG. 1 is a cross sectional view showing the operation of a threaded driving structure for an automatic umbrella according to a first embodiment of the present invention.
Figure 2:
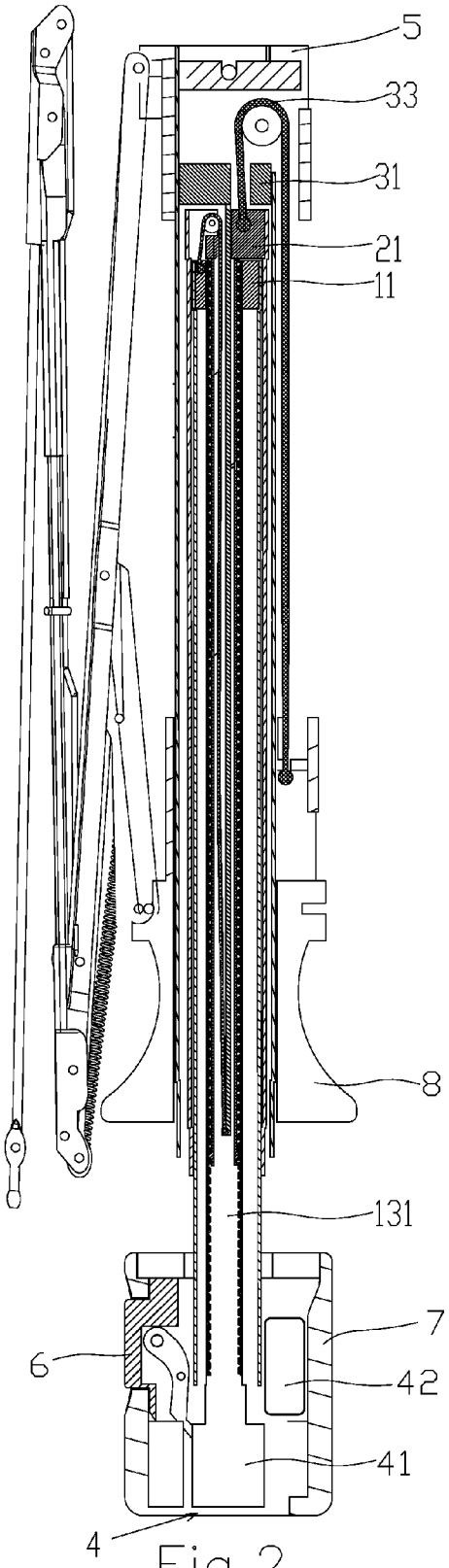
FIG. 2 is another cross sectional view showing the operation of the threaded driving structure for the automatic umbrella according to the first embodiment of the present invention.

For example, as shown in FIGS. 1 and 2, a threaded driving structure for an automatic umbrella according to a first embodiment of the present invention comprises: a first stick section 1, a second stick section 2, and a third stick section 3, wherein the second stick section 2 is fitted onto an outer wall of the first stick section 1 and slides relative to the first stick section 1. The first stick section 1 includes a first fixing sleeve 11 disposed on a top end thereof, and the first fixing sleeve 11 has a first orifice 111 defined thereon. The second stick section 2 includes a second fixing sleeve 21 mounted on a top end thereof, the first stick section 1 also includes a first support member 13 mounted therein, and the first support member 13 has inner threads arranged therein, the second stick section 2 also includes a screw rod 22 fixed therein, and the screw rod 22 has outer threads arranged thereon (in this embodiment, the first support member 13 is cylindrical), wherein an upper end of the screw rod 22 is connected with the second fixing sleeve 21, and a lower end of the screw rod 22 is screwed with the inner threads of the first support member 13 via the first orifice 111. A lower end of the first support member 13 is joined with a power apparatus 4. In this embodiment, the power apparatus drives the first support member 13 to rotate, and the screw rod 22 moves upwardly and downwardly along the first support member 13. The third stick section 3 is fitted on an outer wall of the second stick section 2 and slides relative to the second stick section 2, wherein the third stick section 3 includes a third fixing sleeve 31 disposed on a top end thereof, and the second fixing sleeve 21 has a second orifice 23 defined thereon. In addition, the third stick section 3 also includes a second support member 32 mounted therein, wherein an upper end of the second support member 32 is in connection with the third fixing sleeve 31, and a lower end of the second support member 32 is inserted into the second orifice 23. The second stick section 1 further includes a first pull rope 24, an upper segment 241 of which is coupled with the lower end of the second support member 32 through a support portion 25 on the second fixing sleeve 21. The screw rod 22 also has an accommodation space 131 formed therein to accommodate the second support member 32 and the first pull rope 24.

In assembly, a first runner 8 is fitted on the third stick section 3, and a second runner 5 is fixed on an upper end of the third stick section 3, wherein the second runner 5 has plural first stretchers 51, plural second stretchers 52 secured among the plural first stretchers 51 and the first runner 8, and plural springs 53 fitted among the plural second stretchers 52 and the plural first stretchers 51. The power apparatus 4 is fixed in a handle 7 on a lower end of the first stick section 1, In this embodiment, the power apparatus 4 includes a battery 42 and a micro motor 41 driven by the battery 42 (the power apparatus 4 can be manually operated to provide power as well), wherein the battery 42 supplies power to the micro motor 41 so that the micro motor 41 drives an output shaft 411 on the first support member 13 to rotate. In this embodiment, a button 6 is configured on the handle 7 and is pressed to drive the micro motor 41 to rotate, such that the micro motor 41 drives the support member 13 to rotate clockwise, and the screw rod 22 moves upwardly along the first support member 13 (in this embodiment, when the first support member 13 rotates counterclockwise, the screw rod 22 moves downwardly along the first support member 13), hence the second stick section 2 is driven by the screw rod 22 to slide upwardly. Thereafter, the upper segment 241 of the first pull rope 24 in the second stick section 2 pulls the second support member 32 upwardly to drive the third stick section 3 to slide upwardly, such that the first stick section 1, the second stick section 2, and the third stick section 3 stretch completely, wherein the plural first stretchers 51 and the plural second stretchers 52 are driven by the third stick section 3 to stretch outwardly, and the plural springs 53 store energy so that when the button 6 is released, the first support member 13 stops rotation. As desiring to retract the automatic umbrella, the button 6 is pressed again so that the first support member 13 rotates counterclockwise, and then the plural springs 53 drive a second rope 33 to pull the first runner 8 downwardly, thereafter the first pull rope 24 is pulled downwardly by the second support member 32, and the first pull rope 24 and the second support member 43 move into the first support member 13. When the first support member 13 rotates counterclockwise, the screw rod 22 moves downwardly along the first support member 13, and the first pull rope 24 and the second support member 32 move into the accommodation space 131 of the screw rod 22, such that the automatic umbrella is retracted, and the button 6 is released to stop a rotation of the screw rod 22. Accordingly, the power apparatus 4 supplies the power to rotate the first support member 13, and then the screw rod 22 is driven by the first support member 13 to move upwardly and downwardly along the first support member 13, such that the plural springs 53 do not produce excess elasticity, thus stretching the automatic umbrella safely and prolonging a service life of the automatic umbrella.

Figure 3:
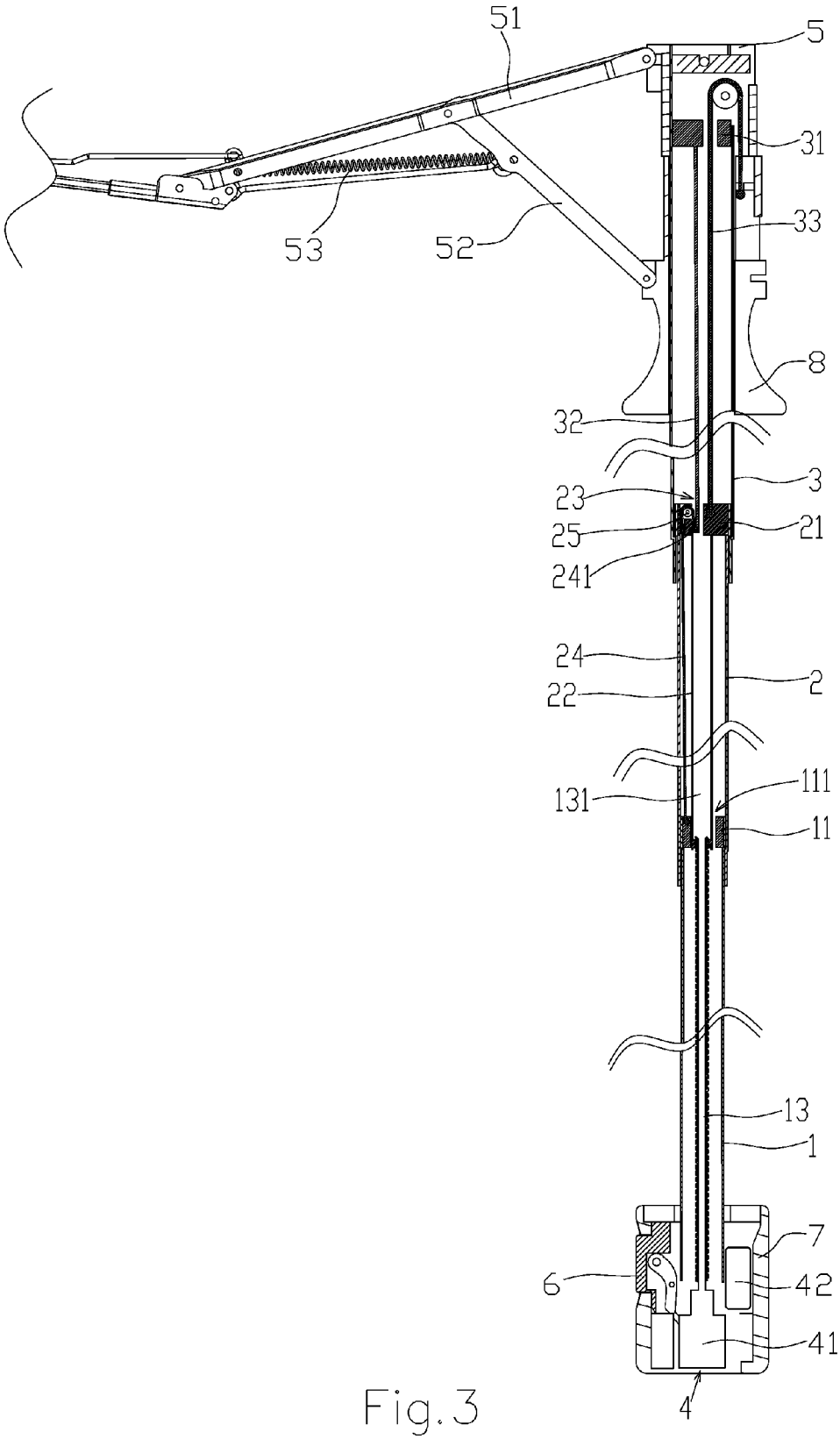
FIG. 3 is a cross sectional view showing the operation of a threaded driving structure for an automatic umbrella according to a second embodiment of the present invention.
Figure 4:
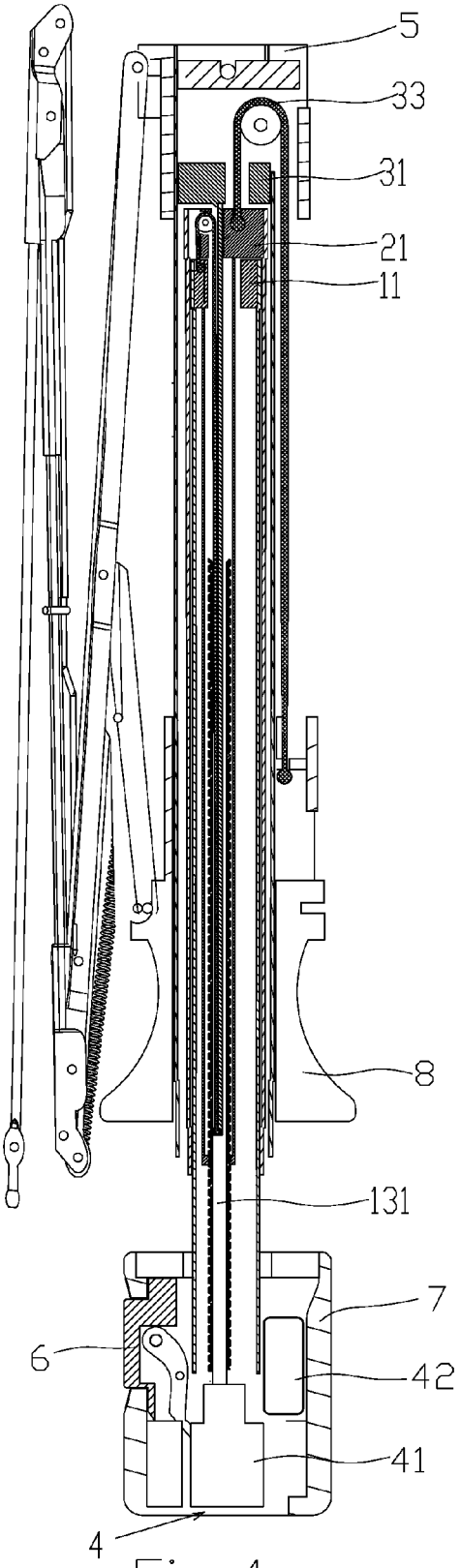
FIG. 4 is another cross sectional view showing the operation of the threaded driving structure for the automatic umbrella according to the second embodiment of the present invention.

Referring to FIGS. 3 and 4, a difference of an automatic umbrella of a second embodiment from that of the first embodiment comprises: the first stick section 1 including a first support member 13 with outer threads, the second stick section 2 including a screw rod 22 with inner threads, the first support member 13 having an accommodation space 131 for accommodating the second support member 32 and the first rope 24.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A threaded driving structure for an automatic umbrella at least comprising: a first stick section (1) and a second stick section (2) fitted on an outer wall of the first stick section (1) and sliding relative to the first stick section (1), the first stick section (1) including a first fixing sleeve (11) disposed on a top end thereof, and the first fixing sleeve (11) having a first orifice (111) defined thereon, the second stick section (2) including a second fixing sleeve (21) mounted on a top end thereof, characterized in that: the first stick section (1) includes a first support member (13) mounted therein, and the first support member (13) has inner threads arranged therein, the second stick section (2) includes a screw rod (22) fixed therein, and the screw rod (22) has outer threads arranged thereon, an upper end of the screw rod (22) is connected with the second fixing sleeve (21), and a lower end of the screw rod (22) is screwed with the inner threads of the first support member (13) via the first orifice (111), a lower end of the first support member (13) is joined with a power apparatus (4), such that the power apparatus (4) drives the first support member to rotate, and then the screw rod (22) moves upwardly and downwardly along the first support member (13); and a third stick section (3) fitted on an outer wall of the second stick section (2) and sliding relative to the second stick section (2), wherein the third stick section (3) includes a third fixing sleeve (31) disposed on a top end thereof, and the second fixing sleeve (21) has a second orifice (23) defined thereon, the third stick section (3) also includes a second support member (32) mounted therein, wherein an upper end of the second support member (32) is in connection with the third fixing sleeve (31), and a lower end of the second support member (32) is inserted into the second orifice (23), the second stick section (1) further includes a first pull rope (24), an upper segment (241) of which is coupled with the lower end of the second support member (32) through a support portion (25) on the second fixing sleeve (21); the screw rod (22) also has an accommodation space (131) formed therein to accommodate the second support member (32) and the first pull rope (24).

2. A threaded driving structure for an automatic umbrella at least comprising: a first stick section (1) and a second stick section (2) fitted on an outer wall of the first stick section (1) and sliding relative to the first stick section (1), the first stick section (1) including a first fixing sleeve (11) disposed on a top end thereof, and the first fixing sleeve (11) having a first orifice (111) defined thereon, the second stick section (2) including a second fixing sleeve (21) mounted on a top end thereof, characterized in that: the first stick section (1) includes a first support member (13) mounted therein, and the first support member (13) has outer threads arranged therein, the second stick section (2) includes a screw rod (22) fixed therein, and the screw rod (22) has inner threads arranged thereon, an upper end of the screw rod (22) is connected with the second fixing sleeve (21), and a lower end of the screw rod (22) is screwed with the outer threads of the first support member (13) via the first orifice (111), a lower end of the first support member (13) is joined with a power apparatus (4), such that the power apparatus (4) drives the first support member to rotate, and the screw rod (22) moves upwardly and downwardly along the first support member (13); and a third stick section (3) fitted on an outer wall of the second stick section (2) and sliding relative to the second stick section (2), wherein the third stick section (3) includes a third fixing sleeve (31) disposed on a top end thereof, and the second fixing sleeve (21) has a second orifice (23) defined thereon, the third stick section (3) also includes a second support member (32) mounted therein, wherein an upper end of the second support member (32) is in connection with the third fixing sleeve (31), and a lower end of the second support member (32) is inserted into the second orifice (23), the second stick section (1) further includes a first pull rope (24), an upper segment (241) of which is coupled with the lower end of the second support member (32) through a support portion (25) on the second fixing sleeve (21); the first support member (13) also has an accommodation space (131) formed therein to accommodate the second support member (32) and the first pull rope (24).

* * * * *